US009004986B2

(12) United States Patent
Byers

(10) Patent No.: US 9,004,986 B2
(45) Date of Patent: Apr. 14, 2015

(54) SHARPENING TOOL

(75) Inventor: Gary L. Byers, Columbia Falls, MT (US)

(73) Assignee: Locan Properties, LLC., Columbia Falls, MT (US)

( * ) Notice: Subject to any disclaimer, the term of this patent is extended or adjusted under 35 U.S.C. 154(b) by 78 days.

(21) Appl. No.: 13/369,122

(22) Filed: Feb. 8, 2012

(65) Prior Publication Data

US 2012/0202410 A1 Aug. 9, 2012

Related U.S. Application Data

(60) Provisional application No. 61/440,596, filed on Feb. 8, 2011.

(51) Int. Cl.
*B24B 3/00* (2006.01)
*B24D 15/06* (2006.01)

(52) U.S. Cl.
CPC ..... *B24D 15/063* (2013.01)

(58) Field of Classification Search
USPC ..... 451/557; 76/82, 86, 88
See application file for complete search history.

(56) References Cited

U.S. PATENT DOCUMENTS

| | | | | | |
|---|---|---|---|---|---|
| 5,291,805 | A | * | 3/1994 | Byers et al. | 76/88 |
| D365,740 | S | * | 1/1996 | Smith | D8/93 |
| 5,488,885 | A | * | 2/1996 | Byers et al. | 76/86 |
| D369,081 | S | * | 4/1996 | Byers et al. | D8/91 |
| 5,673,599 | A | * | 10/1997 | Byers et al. | 76/86 |
| 5,679,068 | A | * | 10/1997 | Byers et al. | 451/557 |
| D387,262 | S | * | 12/1997 | Byers et al. | D8/91 |
| D394,596 | S | * | 5/1998 | Byers et al. | D8/91 |
| 6,393,946 | B1 | * | 5/2002 | Kenesky et al. | 76/86 |
| D570,179 | S | * | 6/2008 | Byers | D8/93 |
| 2007/0266828 | A1 | * | 11/2007 | Byers | 76/82 |

* cited by examiner

*Primary Examiner* — Murina Rachuba
(74) *Attorney, Agent, or Firm* — Jean Kyle

(57) ABSTRACT

A portion of the sharpener handle is recessed to receive the curved blade of a lopper. The cutaway allows the sharpening element to sharpen the lopper blade along its entire length. Additional sharpening elements can be positioned along the handle to provide a multipurpose sharpening tool.

11 Claims, 12 Drawing Sheets

SHARPENING TOOL

CROSS-REFERENCE TO RELATED APPLICATIONS

This application claims the benefits of U.S. Provisional Application No. 61/440,596, filed Feb. 8, 2011, the disclosure of which is hereby incorporated by reference in its entirety including all figures, tables and drawings.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

A sharp tool make any job easier. A sharp blade can also be important in insuring a job is done right. For example, a lopper blade must be sharp to prevent pruned branches from being crushed. Damage to a pruning wound from crushing or a ragged cut due to a dull blade makes the area vulnerable to disease. Loppers have odd shaped blades that make them difficult to sharpen. It is impossible to reach the base of a lopper blade with a guarded sharpener. A need remains for a sharpener for a lopper that is safe and effectively sharpens to the base of a lopper blade.

All patents, patent applications, provisional patent applications and publications referred to or cited herein, are incorporated by reference in their entirety to the extent they are not inconsistent with the teachings of the specification.

BRIEF SUMMARY OF THE INVENTION

The invention involves a sharpening tool for a lopper. A sharpening section of the tool receives the curved lopper blade and insures the entire length of the blade is sharpened. Preferably, the tool handle provides a solid gripping surface, protects the user's fingers and makes the tool safe to use.

DETAILED DESCRIPTION OF THE INVENTION

Figure 1:
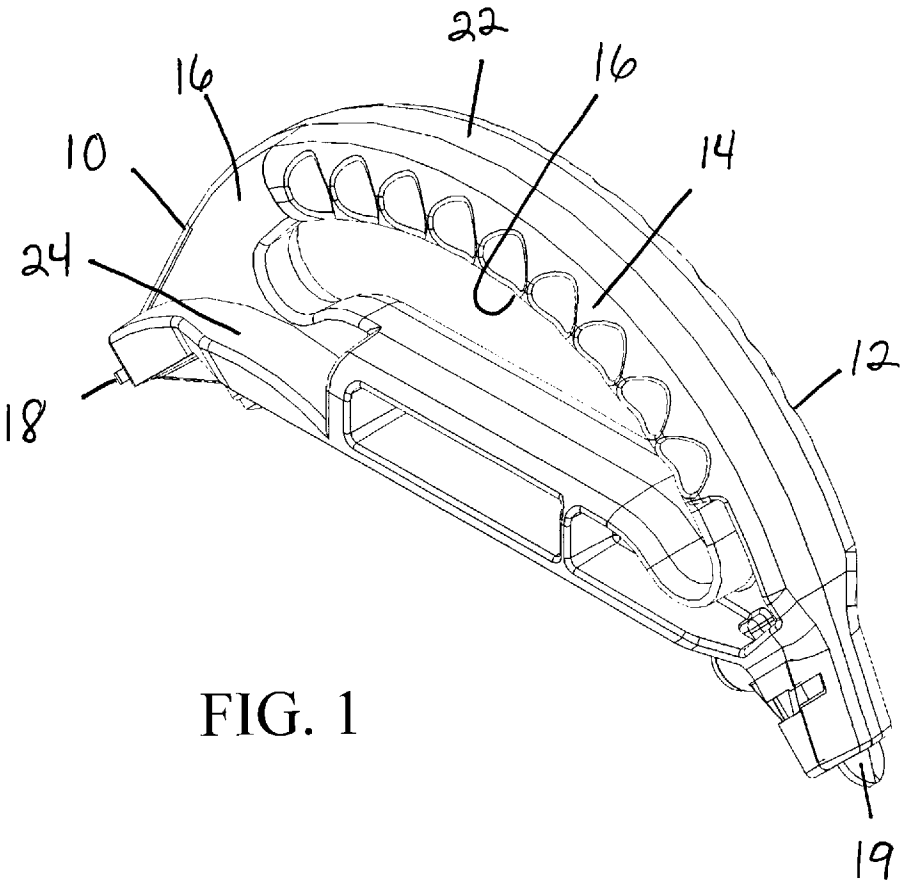
FIG. 1 is a rear top perspective view of a preferred embodiment of the sharpening tool of the subject invention.
Figure 2:
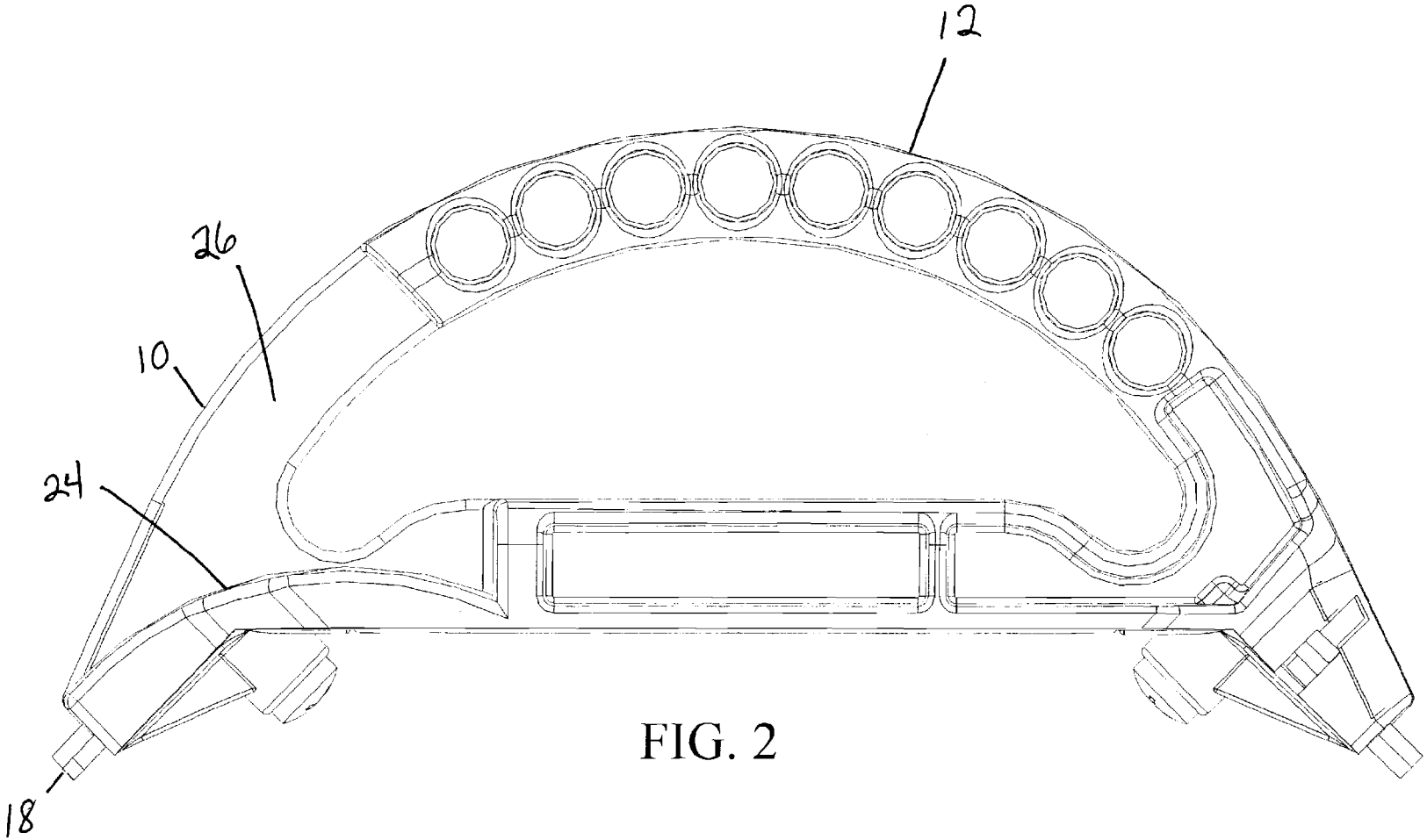
FIG. 2 is a side elevational view of the preferred embodiment of the sharpening tool shown in FIG. 1.
Figure 3:
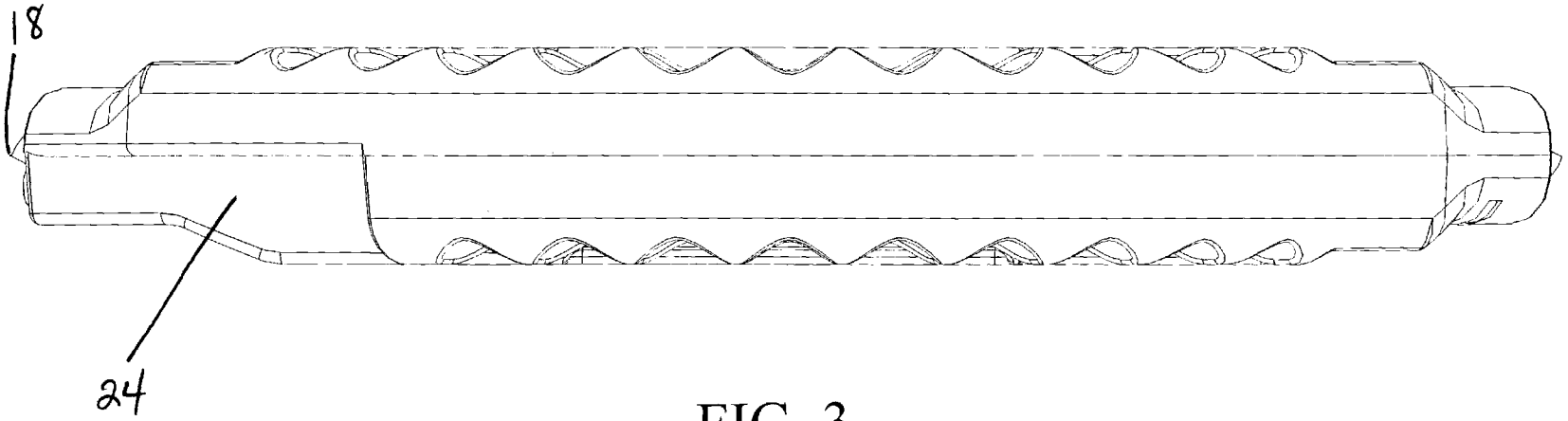
FIG. 3 is a top plan view of the preferred embodiment of the sharpening tool shown in FIG. 1.

The invention involves a sharpening tool that sharpens a lopper along its entire blade. A curved sharpening section receives the lopper blade.

Preferred embodiments of sharpeners having the unique sharpening section of the subject invention that receives curved lopper blades are shown in FIGS. 1-12. Bypass loppers have two curved blades that intersect. Anvil loppers have a single blade that meets a flat surface. The single blade of an anvil lopper often has a rounded outer edge. The sharpening section of the subject invention receives the curved blades and/or rounded edges of the lopper to allow a sharpening element to reach the base of the lopper blade so that the entire length of the blade can be sharpened.

In a preferred embodiment shown in FIGS. 1-6, the sharpening section 10 is a cutaway in the handle 12 of the sharpener. The handle has a general D shape. A user grabs the handle by the curve of the D 14 while the user's fingers curl into the center of the D 16. Sharpening elements 18 are positioned at the intersection of the curve of the D 14 and the straight back of the D 20. The user directs pressure and guides the tool while sharpening with a thumb placed on the outside of the curved D surface 22. The subject sharpening section 10 comprises a sloped surface 24 over which a curved blade can travel along the back of the D 20 (see, for example, FIGS. 1 and 2) and a wall 26 on the curve of the D 14 (see, for example, FIGS. 3 and 4) to support the top of the curved blade or the rounded outer edge of a anvil lopper blade. In this embodiment, both the curved surface 24 and the wall 26 are cutaway from the width of the handle.

Figure 10:
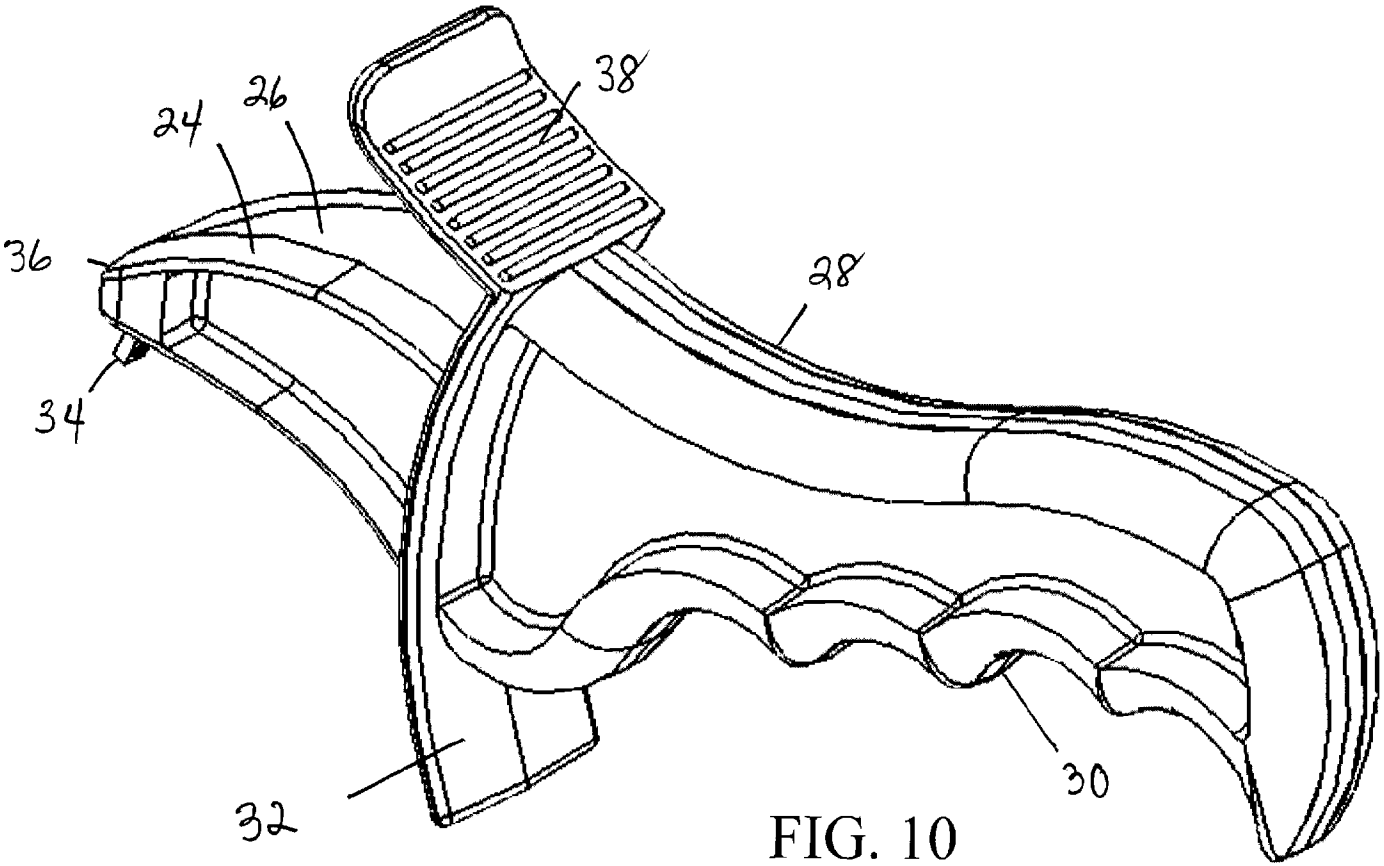
FIG. 10 is a rear top perspective view of another preferred embodiment of the sharpening tool of the subject invention.
Figure 11:
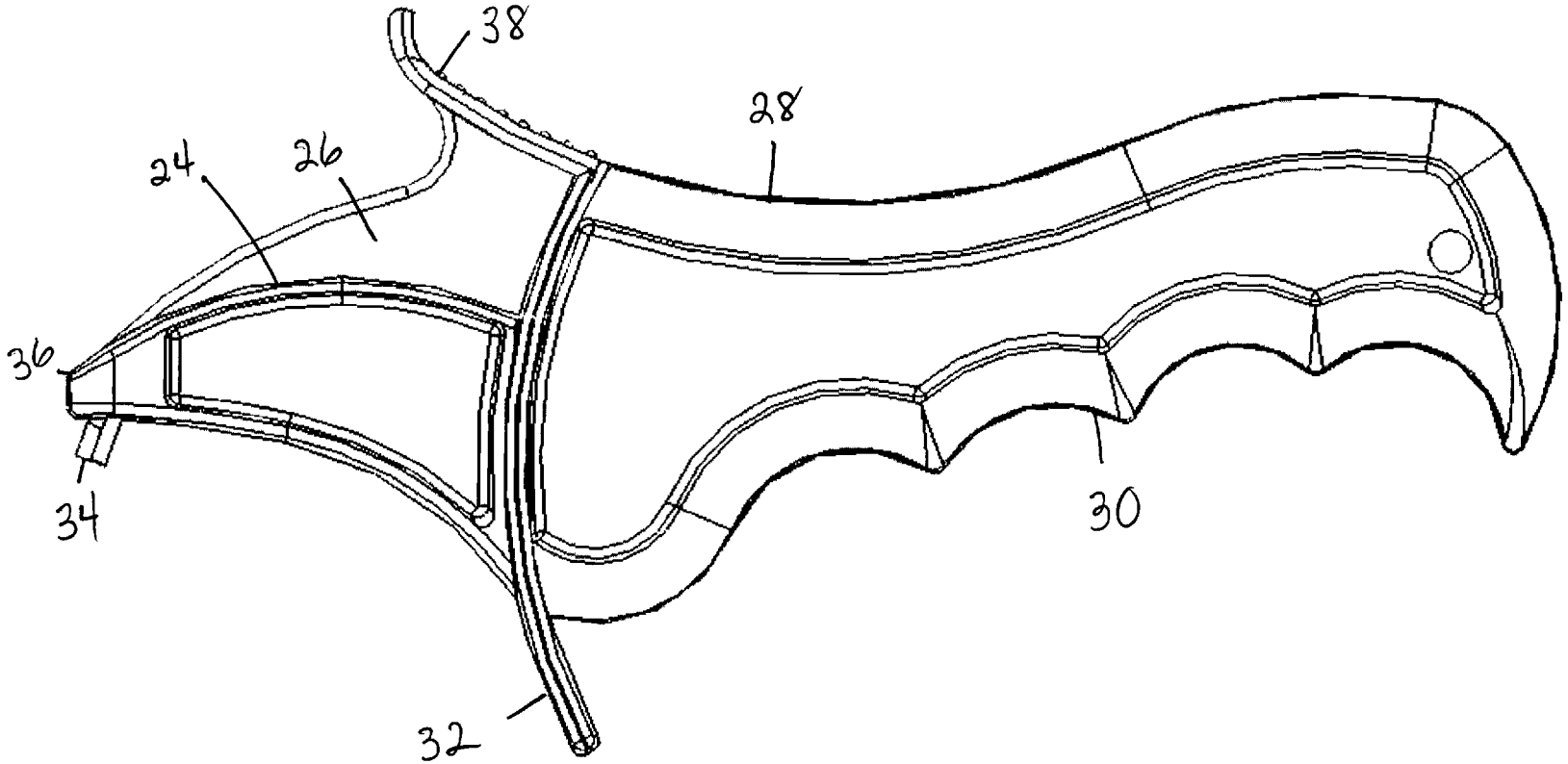
FIG. 11 is a side elevational view of the preferred embodiment of the sharpening tool shown in FIG. 10.
Figure 12:
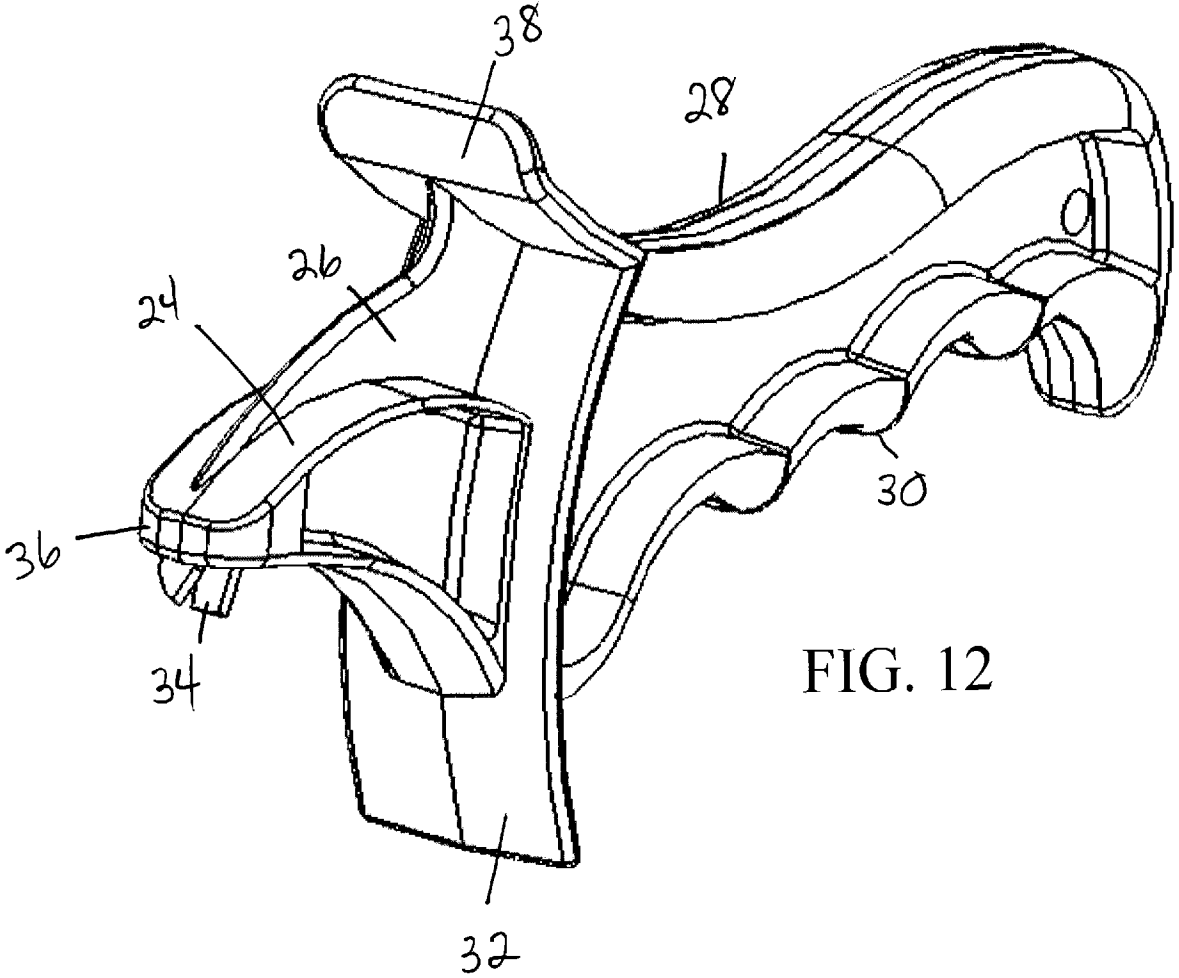
FIG. 12 front end perspective view of the preferred embodiment of the sharpening tool shown in FIG. 10.

In another preferred embodiment shown in FIGS. 10-12, the handle is a pistol grip. A dip in the handle 28 allows it to be comfortably grabbed between the thumb and forefinger. The fingers wrap around the handle. Indentations 30 on the underside of the handle facilitate grip. A guard 32 protects the fingers from the blade being sharpened by the sharpening element 34. The handle supports the sharpening section 10. The sharpening section 10 has a sloped surface 24 to receive the curved blade of a lopper. A sharpening element 34 is disposed at an end 36 of the sloped surface 24, and a wall 26 adjacent the sloped surface supports the blade as it is run across the sloped surface through the sharpening element.

The handle of the sharpening tool of the subject invention should be sturdy and provide a firm grip. In the exemplified embodiments the handle has been textured to improve grip. The handle can be made from a variety of materials, including but not limited to, wood, metal, and plastic. A plastic molded handle is inexpensive to produce, durable, and lightweight. Plastic also is appealing in that it offers a variety of colors. Preferably, the handle is configured to protect the hand and fingers of the user from the blade being sharpened. The handle also preferably provides some control or leverage when sharpening a blade. For example, the embodiment shown in FIGS. 10-12 have a thumb plate 38 to allow the user to guide the sharpening element 34 along the blade and apply pressure to the element as it is sharpening the blade. As noted above, the handles of the exemplified embodiments are D shaped and a pistol grip. One skilled in the art would realize however that the handle can be any shape that firmly supports the sharpening section. Further, while the subject section is shown fashioned in the handle of some of the exemplified tools, the sharpening section can be independent of the handle or part of a mounting surface.

Figure 4:
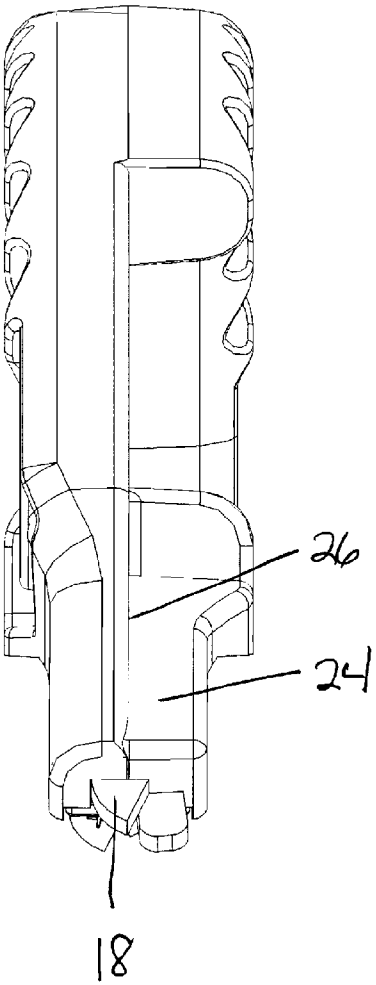
FIG. 4 is a front end elevational view of the preferred embodiment of the sharpening tool shown in FIG. 1.
Figure 5:
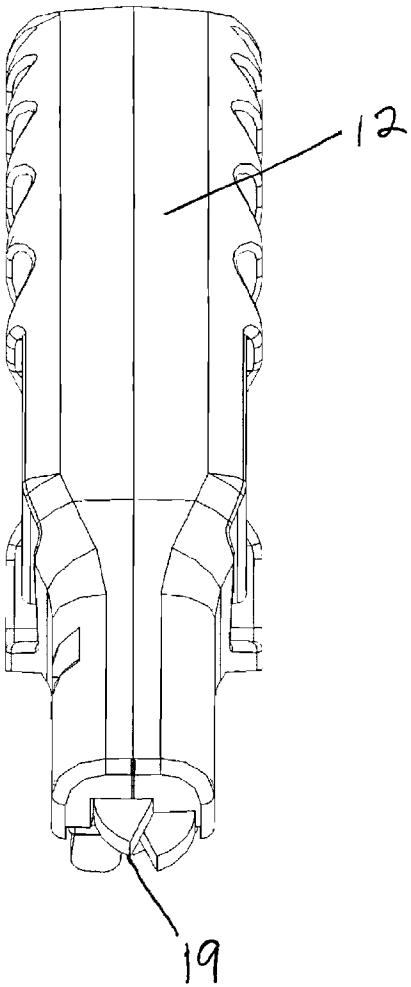
FIG. 5 is a rear end elevational view of the preferred embodiment of the sharpening tool shown in FIG. 1.

A preferred sharpening element 18 for sharpening a lopper blade is shown in FIG. 4. In this embodiment, the element is positioned at the intersection of the curve of the D 14 and the back of the D 20 and protrudes from the surface. This allows the element to reach the base of the blade when the blade is slipped along the sloped surface 24 of the sharpening section 10 cutaway from the handle 12. The sharpening element shown is just a preferred embodiment and one skilled in the art would recognize there are other suitable elements for sharpening such blades.

Several of the exemplified embodiments further show the sharpening section of the subject invention can be incorporated into a tool supporting multiple sharpening elements. The embodiment shown in FIGS. 1-6 is a 3 in 1 tool and can be used to sharpen lopper blades with the element 18 shown in FIG. 4 and scissors and knives with the sharpening element 19 shown in FIG. 5. Two additional sharpening elements have been added to the preferred embodiment shown in FIGS. 7-9. This embodiment is a 5 in 1 tool wherein sharpening elements 38, 40, for an axe and law and garden tools, respectively, have been added to the backbone of the D. The axe and garden tool sharpening elements are guarded preventing contact of the sharpening surface by the user. In these exemplified embodiments, the elements are protected by a piece of the handle however independent guard pieces can be applied to the unit.

Figure 6:
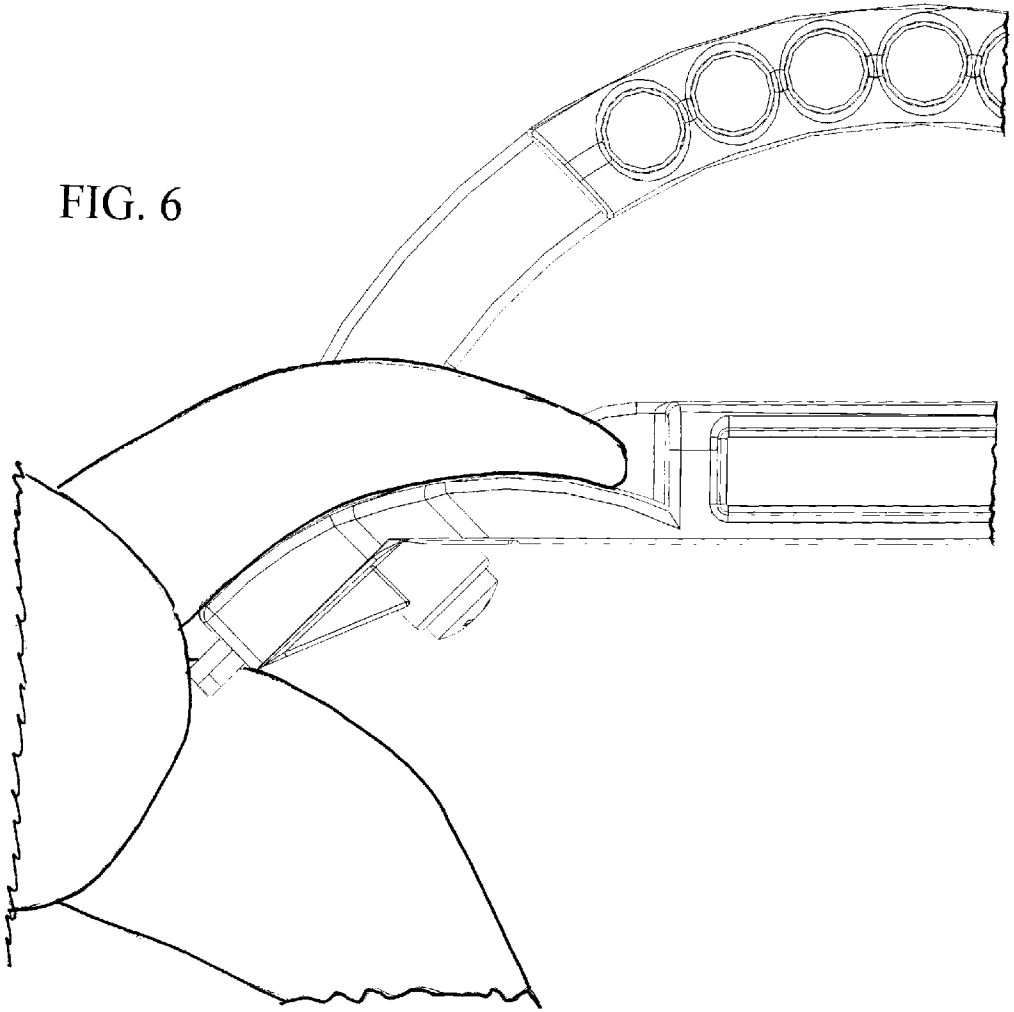
FIG. 6 is a partial side elevational view of the preferred embodiment shown in FIG. 1 engaging the curved blades of a lopper.
Figure 7:
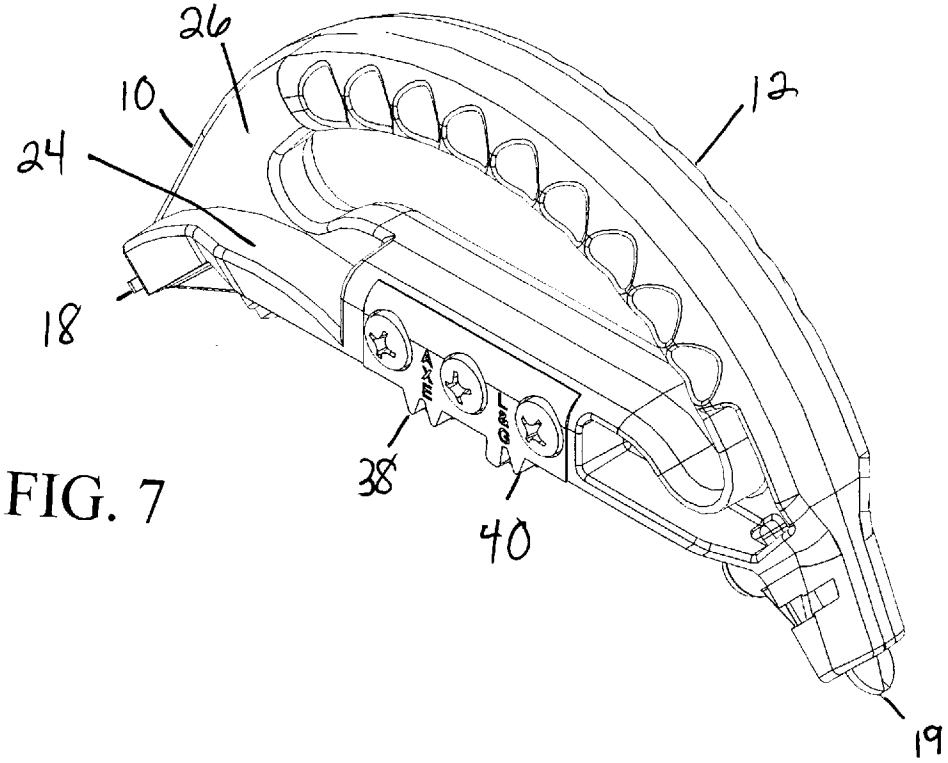
FIG. 7 is a rear top perspective view of another preferred embodiment of the sharpening tool of the subject invention.
Figure 8:
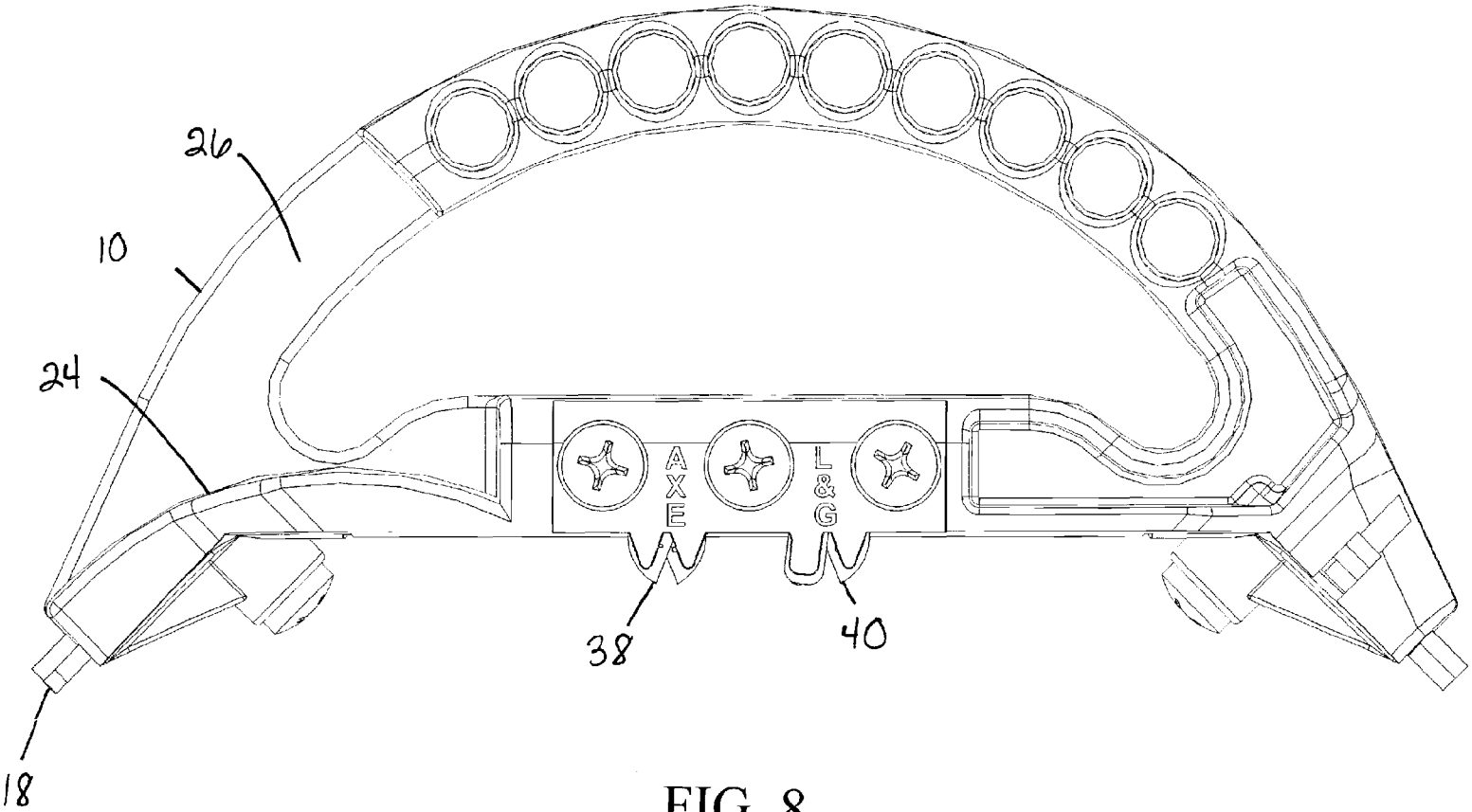
FIG. 8 is a side elevational view of the preferred embodiment of the sharpening tool shown in FIG. 7.
Figure 9:
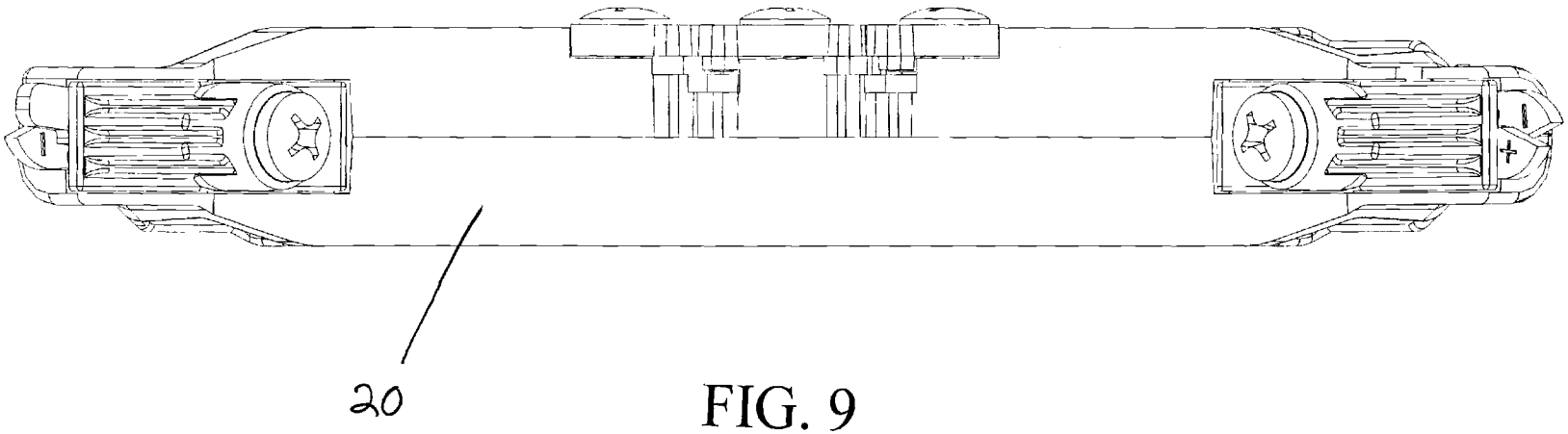
FIG. 9 is a bottom plan view of the preferred embodiment of the sharpening tool shown in FIG. 7.

The sharpening section of the sharpening tool of the subject invention sharpens a lopper blade to its base (FIG. 6). The sharpening section allows the sharpening element to reach the base of the blade while the hand of the user is protected. The subject invention provides a safe, comfortable means of maintaining a garden lopper.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A sharpening tool for sharpening a lopper having at least one cutting edge opposite a curved blade, a base of the at least one cutting edge pivotally connected to a base of the curved blade, the sharpening tool comprising:

a handle; and a sharpening section supported by the handle, the sharpening section comprising a sloped surface capable of receiving the curved blade, a wall adjacent the sloped surface to support the curved blade on the sloped surface, and a sharpening element disposed at an end of the sloped surface to sharpen the at least one cutting edge;

whereby the entire cutting edge of the at least one cutting edge is sharpened when the curved blade is placed on the sloped surface to position the sharpening element at the base of the at least one cutting edge and the sharpening element is drawn over the length of the at least one cutting edge and the curved blade moves along and falls away from the sloped surface.

2. The sharpening tool of claim 1, wherein said handle is configured to be capable of supplying leverage to said sharpening element.

3. The sharpening tool of claim 1, wherein said handle is D shaped.

4. The sharpening tool of claim 1, wherein said sharpening section is cutaway into said handle.

5. The sharpening tool of claim 1, wherein said handle is D shaped and said sharpening section is cutaway into said handle.

6. The sharpening tool of claim 1, further comprising a guard to shield said at least one cutting edge being sharpened from a user.

7. The sharpening tool of claim 1, further comprising at least one sharpening element other than said sharpening element of said sharpening section.

8. A sharpening tool for sharpening a lopper having at least one cutting edge opposite a curved blade, a base of the at least one cutting edge pivotally connected to a base of the curved blade, the sharpening tool comprising:

a handle; and a sharpening section cutaway from a width of the handle, the sharpening section comprising a sloped surface capable of receiving the curved blade, a wall adjacent the sloped surface to support the curved blade on the sloped surface, and a sharpening element disposed at an end of the sloped surface to sharpen the at least one cutting edge;

whereby the entire cutting edge of the at least one cutting edge is sharpened when the curved blade is placed on the sloped surface to position the sharpening element at the base of the at least one cutting edge and the sharpening element is drawn run over the length of the at least one cutting edge and the curved blade moves along and falls away from the sloped surface.

9. The sharpening tool of claim 8, wherein said handle is D shaped.

10. The sharpening tool of claim 8, further comprising at least one sharpening element other than said sharpening element of said sharpening section.

11. The sharpening tool of claim 1, wherein said handle is a pistol grip.

* * * * *